US008736501B2

(12) United States Patent
Nishi et al.

(10) Patent No.: US 8,736,501 B2
(45) Date of Patent: May 27, 2014

(54) MULTI-BAND ANTENNA

(75) Inventors: Takafumi Nishi, Okazaki (JP); Yuji Sugimoto, Kariya (JP); Masayuki Nakabuchi, Hekinan (JP); Ichiro Shigetomi, Nagoya (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 185 days.

(21) Appl. No.: 13/424,702

(22) Filed: Mar. 20, 2012

(65) Prior Publication Data

US 2012/0242552 A1 Sep. 27, 2012

(30) Foreign Application Priority Data

Mar. 22, 2011 (JP) ..... 2011-063093

(51) Int. Cl.
*H01Q 9/32* (2006.01)
*H01Q 5/00* (2006.01)
*H01Q 5/01* (2006.01)

(52) U.S. Cl.
CPC ..... *H01Q 9/32* (2013.01); *H01Q 5/0034* (2013.01); *H01Q 5/01* (2013.01)
USPC ..... 343/749; 343/751

(58) Field of Classification Search
CPC ..... H01Q 9/32; H01Q 5/0034; H01Q 5/01
USPC ..... 343/749, 751, 793, 802, 810
See application file for complete search history.

(56) References Cited

U.S. PATENT DOCUMENTS

| | | | | |
|---|---|---|---|---|
| 6,163,300 | A | 12/2000 | Ishikawa et al. | |
| 6,965,353 | B2 * | 11/2005 | Shirosaka et al. | 343/802 |
| 2006/0208957 | A1 | 9/2006 | Iizuka et al. | |
| 2009/0040124 | A1 * | 2/2009 | Iizuka et al. | 343/806 |
| 2012/0139813 | A1 * | 6/2012 | Anguera et al. | 343/858 |

FOREIGN PATENT DOCUMENTS

| | | |
|---|---|---|
| JP | 11-055022 | 2/1999 |
| JP | 2006-295873 | 10/2006 |

OTHER PUBLICATIONS

Office Action issued Dec. 4, 2013 in corresponding CN Application No. 201210077866.3 (with English translation).

* cited by examiner

*Primary Examiner* — Hoanganh Le
(74) *Attorney, Agent, or Firm* — Harness, Dickey & Pierce, PLC

(57) ABSTRACT

A multi-band antenna includes two conductive wirings and unit circuits cascaded along the conductive wirings. Each unit circuit includes a communication unit, a first capacitor and a second inductor. The communication unit connects between the conductive wirings through a first inductor and a second capacitor connected in series with the first inductor. The first capacitor and the second inductor are inserted in at least one of the conductive wirings. The second inductor is connected in parallel with the first capacitor. Alternatively, the unit circuit includes a communication unit connecting between the conductive wirings through a first inductor, and a first capacitor inserted in at least one of the conductive wirings. The first inductor, the first capacitor, a third capacitor disposed between the conductive wirings, and a third inductor disposed on at least one of the conductive wirings satisfy a relationship expressed by the expression 2.

4 Claims, 8 Drawing Sheets

FIG. 7A HIGH-FREQUENCY SIDE (0.75[GHz])
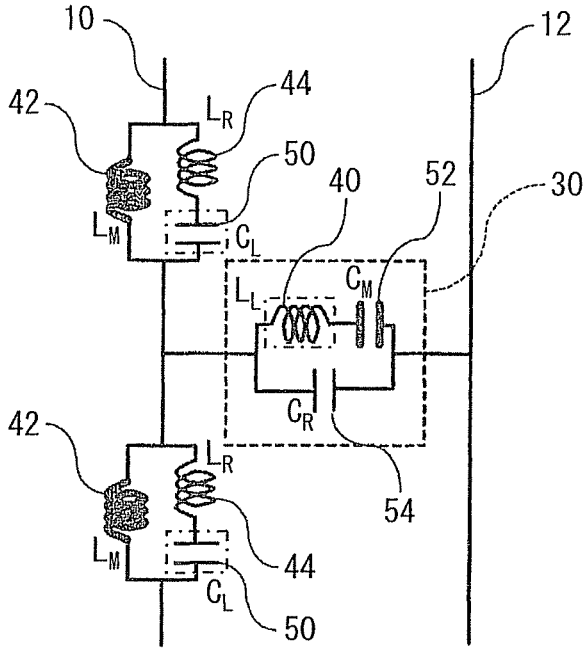
FIG. 7B LOW-FREQUENCY SIDE (0.3[GHz])
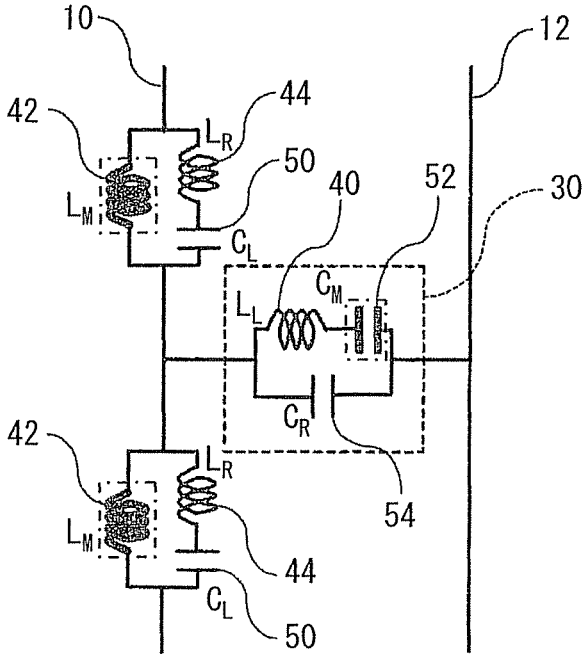

MULTI-BAND ANTENNA

CROSS REFERENCE TO RELATED APPLICATION

This application is based on Japanese Patent Application No. 2011-63093 filed on Mar. 22, 2011, the disclosure of which is incorporated herein by reference.

TECHNICAL FIELD

The present disclosure relates to a multi-band antenna that transmits and receives radio waves having different frequencies.

BACKGROUND

A technique that transmits and receives radio waves having different frequencies through a single antenna has been known as a trap load technique. In the trap load technique, for example, in a case of transmitting and receiving two radio waves having different frequencies such as a high frequency and a low frequency, an LC parallel resonant circuit (trap) that resonates at the high frequency is connected to a quarter of the wavelength of the high frequency so as to resonate the antenna at the high frequency. Because the electric current does not flow at the part where the trap is connected, the radio wave having the frequency corresponding to the quarter of the wavelength, that is, the radio wave having the high frequency is transmitted and received.

With regard to the radio wave having the low frequency, considering that the loaded trap serves as a reactance, the total length of the antenna is adjusted so that the antenna is resonated at the low frequency. As such, the radio wave having the low frequency is transmitted and received.

In this way, the radio waves having different frequencies can be transmitted and received by the single antenna. Such a multi-band antenna is, for example, described in JP11-55022A corresponding to U.S. Pat. No. 6,163,300.

SUMMARY

To transmit and receive radio waves having different frequencies through a single antenna using the trap load technique, the antenna needs to be constructed by cascading multiple traps having different resonance frequencies. In such a case, therefore, the frequencies of the radio waves to be transmitted and received are limited to the values of the resonance frequencies of the traps cascaded. That is, the frequencies of the radio waves to be transmitted and received are likely to be discrete.

It is an object of the present disclosure to provide a multi-band antenna that transmits and receives radio waves having different frequencies.

According to an aspect, a multi-band antenna includes two conductive wirings being substantially parallel to each other as a basic structure and unit circuits cascaded along the conductive wirings. Each of the unit circuits includes a communication unit, a first capacitor and a second inductor. The communication unit connects between the two conductive wirings through a first inductor and a second capacitor connected in series with the first inductor. The first capacitor and the second inductor are inserted in at least one of the conductive wirings. The second inductor is connected in parallel with the first capacitor.

In such a structure, resonance points are given at least two frequencies. That is, radio waves having different frequencies can be transmitted and received by a single antenna. Also, the size of the antenna can be reduced.

In such a structure, for example, a third inductor is necessarily disposed in series with the two conductive wirings, and a third capacitor is necessarily disposed in parallel with the two conductive wirings. The first capacitor is disposed in series with the third inductor, and the first inductor is disposed in parallel with the third capacitor. The second inductor is disposed in parallel with the third inductor and the first capacitor disposed in series with the third inductor. The second capacitor is disposed in series to the first inductor. In such a case, with respect to a higher frequency, operations of the first capacitor and the first inductor are dominant. With respect to a lower frequency, the first capacitor is approximated to an open state, and the first inductor is approximated to a short-circuit state. As such, effects of the second inductor and the second capacitor increase, and operations of the second inductor and the second capacitor are dominant.

For example, the first inductor, the first capacitor, the second inductor, the second capacitor, the third inductor disposed in series with the conductive wirings, and the third capacitor disposed between the conductive wirings satisfy a relationship expressed by a following expression 1:

$$\sqrt{\frac{1}{L_L C_M}} \leq \sqrt{\frac{1}{(L_R + L_M)C_L}} \leq \sqrt{\frac{1}{L_L C_R}\left(1 + \frac{C_R}{C_M}\right)} \leq \sqrt{\frac{1}{L_R C_L}} \quad \text{Ex. 1}$$

in which $L_L$ is the value of the first inductor, $C_L$ is the value of the first capacitor, $L_M$ is the value of the second inductor, $C_M$ is the value of the second capacitor, $L_R$ is the value of the third inductor, and $C_R$ is the value of the third capacitor.

In such a case, the resonance points, that is, each inductor and each capacitor are limited numerically. Therefore, the values of the inductor and the capacitor are easily determined.

According to a second aspect, a multi-band antenna includes two conductive wirings being substantially parallel to each other as a basic structure and unit circuits cascaded along the conductive wirings. Each of the unit circuit includes a communication unit that connects between the conductive wirings through a first inductor, and a first capacitor inserted in at least one of the conductive wirings. The first inductor, the first capacitor, a third capacitor disposed between the conductive wirings, and a third inductor disposed on at least one of the conductive wirings satisfy a relationship expressed by a following expression 2:

$$\sqrt{\frac{1}{L_L C_R}} = \frac{-A + \sqrt{A^2 + \frac{4L_R}{C_L}}}{2L_R} \quad \text{Ex. 2}$$

in which $L_L$ is the value of the first inductor, $C_L$ is the value of the first capacitor, $C_R$ is the value of the third capacitor, and $L_R$ is the value of the third inductor.

In such a structure, radio waves having different frequencies can be transmitted and received by a single antenna. Also, the size of the antenna can be reduced.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which:

FIGS. 7A and 7B are schematic diagrams for illustrating operations of components of the multi-band antenna at the two resonance frequencies according to the first embodiment;

DETAILED DESCRIPTION

First Embodiment

A first embodiment will be described with reference to FIGS. 1 through 7B.

(Structure of Multi-Band Antenna 1)

Figure 1A:
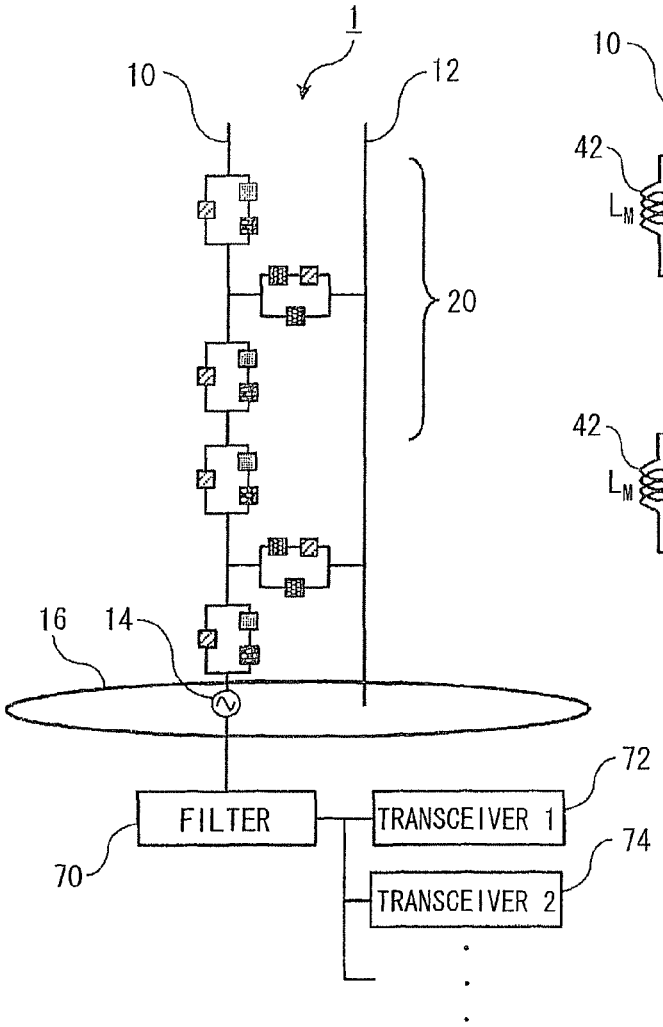
FIG. 1A is a schematic diagram of a multi-band antenna according to a first embodiment.

Referring to FIG. 1A, a multi-band antenna 1 is a monopole type antenna constructed by cascading multiple unit circuits 20 having the same structure along two metal wirings 10, 12 as a basic structure. The two metal wirings 10, 12 are substantially parallel to each other, and are provided as conductive wirings.

A first end of the metal wiring 10 is a feeding point 14, and is connected to multiple transmitting and receiving devices (transceivers) 72, 74 etc. through a band filter 70. A second end of the metal wiring 10 is an open end.

A first end of the metal wiring 12, which is on the same side as the first end of the metal wiring 10, is connected to a GND plate 60 so as to avoid a transmission signal reflecting.

The multi-band antenna 1 having the above-described structure enables to transmit and receive radio waves in association with the multiple transmitting and receiving devices 72, 74 etc.

Figure 1B:
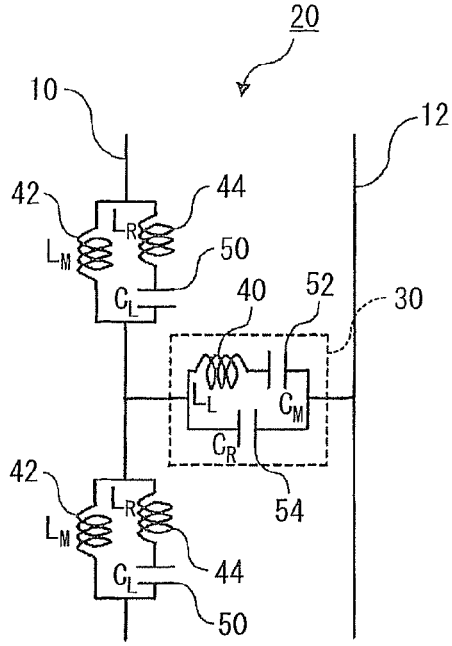
FIG. 1B is a circuit diagram of a unit circuit of the multi-band antenna according to the first embodiment.

As shown in FIG. 1B, the unit circuit 20 includes a communication unit 30, a first capacitor 50 ($C_L$), and a second inductor 42 ($L_M$).

The communication unit 30 has a circuit structure that connects the two metal wiring 10 and the metal wiring 12 to each other through a first inductor 40 having an inductance ($L_L$) and a second capacitor 52 ($C_M$) connected in series with the first inductor 40 ($L_L$).

In the present embodiment, two first capacitors 50 ($C_L$) are inserted in the metal wiring 10. Also, two second inductors 42 ($L_M$) are inserted in the metal wiring 10. The first capacitors 50 ($C_L$) are located on opposite sides of a connecting point to the communication unit 30. Each of the second inductor 42 ($L_M$) is connected in parallel with the corresponding first capacitor 50 ($C_L$).

Figure 2A:
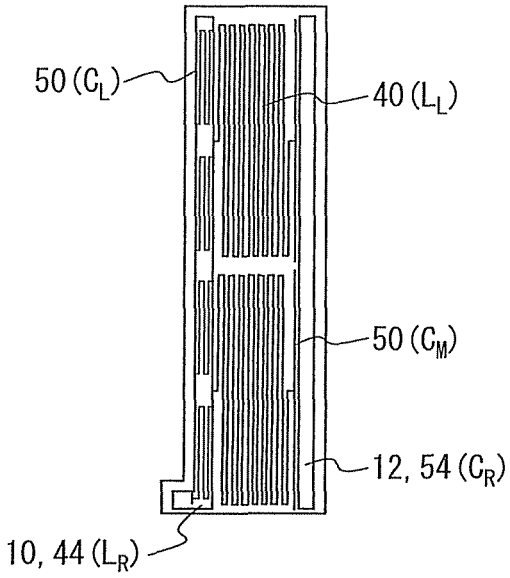
FIG. 2A is a schematic plan view of a front surface of a printed board on which the multi-band antenna is formed according to the first embodiment.
Figure 2B:
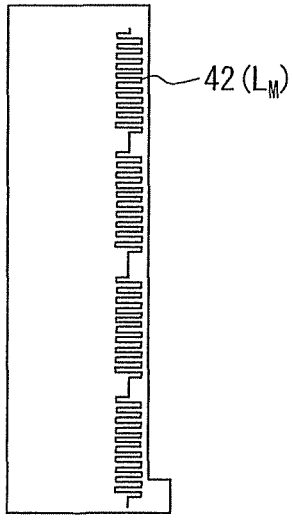
FIG. 2B is a schematic plan view of a rear surface of the printed board according to the first embodiment.

As shown in FIG. 2A, the first inductor 40 ($L_L$) is actually provided by a conductor pattern formed on a front surface of a printed board 80. The conductor pattern of the first inductor 40 ($L_L$) has a meandering shape, for example. As shown in FIG. 2B, the second inductor 42 ($L_M$) is actually provided by a conductor pattern formed on a rear surface of the printed board 80. The conductor pattern of the second inductor 42 ($L_M$) has a meandering shape, for example.

Also, the first capacitor 50 ($C_L$) is provided by a conductor pattern formed on the front surface of the printed board 80. Likewise, the second capacitor 52 ($C_M$) is provided by a conductor pattern formed on the front surface of the printed board 80. The conductor patterns of the first capacitor 50 ($C_L$) and the second capacitor 52 ($C_M$) have a comb-teeth shape, for example. The two metal wirings 10, 12 are provided by conductor patterns such as copper foil formed on the printed board 80, for example.

(Relationship Between Inductor and Capacitor)

In the multi-band antenna 1 having the above-described structure, inductances are necessarily generated in series with the metal wirings 10, 12. Such inductances are referred to as third inductors 44 ($L_R$), as schematically shown in FIG. 1B.

Likewise, a capacitance is generated between the two metal wirings 10, 12. Such a capacitance is referred to as a third capacitor 54 ($C_R$), as schematically shown in FIG. 1B.

A dispersion curve of the multi-band antenna 1 in which the first through third inductors 40, 42, 44 and the first through third capacitors 50, 52, 54 are distributed in the above-described manner is expressed by the following expression 3:

$$\frac{\beta a}{\pi} = \frac{1}{\pi}\cos^{-1}\left\{1 - \frac{1}{2}\left[\frac{1}{\varpi^2 L'_L C'_L} + \varpi^2 L'_R C_R - \left(\frac{L'_R}{L'_L} + \frac{C_R}{C'_L}\right)\right]\right\}, \quad \text{Ex. 3}$$

in which $L'_R$, $C'_2$, $L'_L$, $\alpha$, and $\beta$ are defined as follows:

$$L'_R = L_R\alpha$$

$$C'_L = \frac{C_L}{\alpha}$$

$$L'_L = \frac{L_L}{\beta}$$

$$\alpha = \frac{1}{1 + \frac{L_R}{L_M} - \frac{1}{\varpi^2 L_M C_L}}$$

$$\beta = \frac{1}{1 - \frac{1}{\omega^2 L_L C_M}}$$

Figure 3:
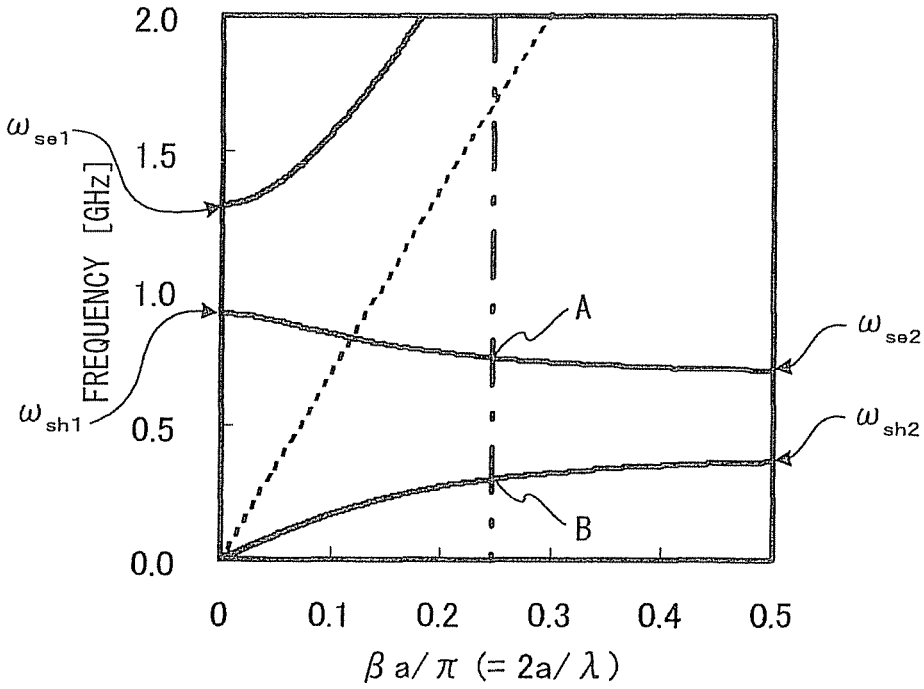
FIG. 3 is a graph illustrating an example of dispersion curves of the multi-band antenna according to the first embodiment.
Figure 4:
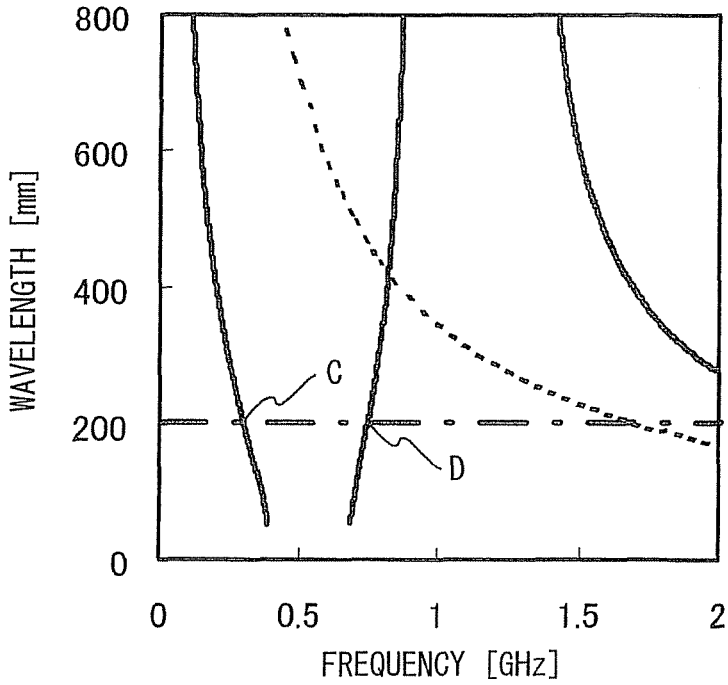
FIG. 4 is a graph illustrating a relationship between frequency and wavelength of the multi-band antenna according to the first embodiment.

FIG. 3 is a graph illustrating an example of the dispersion curve expressed by the expression 3. FIG. 4 is a graph illustrating a relationship between frequency and wavelength.

As shown in FIGS. 3 and 4, it is appreciated that there are two resonance frequencies in the multi-band antenna 1 having a total length of 50 mm.

That is, in FIG. 3, a single-dashed chain line represents a resonance condition, and a solid line represents a dispersion curve. Resonance points are given at two frequencies shown by A point and B point where the single-dashed chain line representing the resonance condition intersects with the solid lines representing the dispersion curves. The frequency of the A point is 0.75 gigahertz (GHz), and the frequency of the B point is 0.3 GHz.

In FIG. 4, a single-dashed chain line represents a resonance condition, and a solid line represents a relationship between the frequency and the wavelength. Thus, similar to FIG. 3, resonance points are given at two frequencies of C point and D point where the single-dashed chain line representing the resonance condition intersects with the curves shown by the solid lines. The frequency of the C point is 0.3 GHz, and the frequency of the D point is 0.75 GHz.

In order to make the multi-band antenna 1 in a multi-band configuration, that is, to transmit and receive radio waves with different frequencies, the frequencies $\omega_{se1}$, $\omega_{sh1}$, $\omega_{se2}$, $\omega_{sh2}$ shown in FIG. 3 need to satisfy a relationship expressed by the following expression 4:

$$\overline{\omega}_{sh2} \leq \overline{\omega}_{se2} \leq \overline{\omega}_{sh1} \leq \overline{\omega}_{se1} \quad \text{Ex. 4}$$

Further, the first through third inductors 40, 42, 44, the first through third capacitors 50, 52, 54 and the frequency relationship expressed by the expression 4 have relationships expressed by the following expressions 5(a) through 5(d):

$$\varpi_{se1} = \sqrt{\frac{1}{L_R C_L}} \quad \text{Ex. 5(a)}$$

$$\varpi_{sh1} = \sqrt{\frac{1}{L_L C_R}\left(1 + \frac{C_R}{C_M}\right)} \quad \text{Ex. 5(b)}$$

$$\varpi_{se2} = \sqrt{\frac{1}{(L_R + L_M)C_L}} \quad \text{Ex. 5(c)}$$

$$\varpi_{sh2} = \sqrt{\frac{1}{L_L C_M}} \quad \text{Ex. 5(d)}$$

Accordingly, the multi-band antenna 1 needs to satisfy the following expression 1 so as to have the multi-band configuration:

$$\sqrt{\frac{1}{L_L C_M}} \leq \sqrt{\frac{1}{(L_R + L_M)C_L}} \leq \sqrt{\frac{1}{L_L C_R}\left(1 + \frac{C_R}{C_M}\right)} \leq \sqrt{\frac{1}{L_R C_L}} \quad \text{Ex. 1}$$

Referring to FIGS. 5A, 5B, 6A and 6B, it will be explained that the resonance frequencies can be continuously changed by changing the inductance $L_M$ of the second inductor 42 and the capacitance $C_M$ of the second capacitor 52.

Figure 5A:
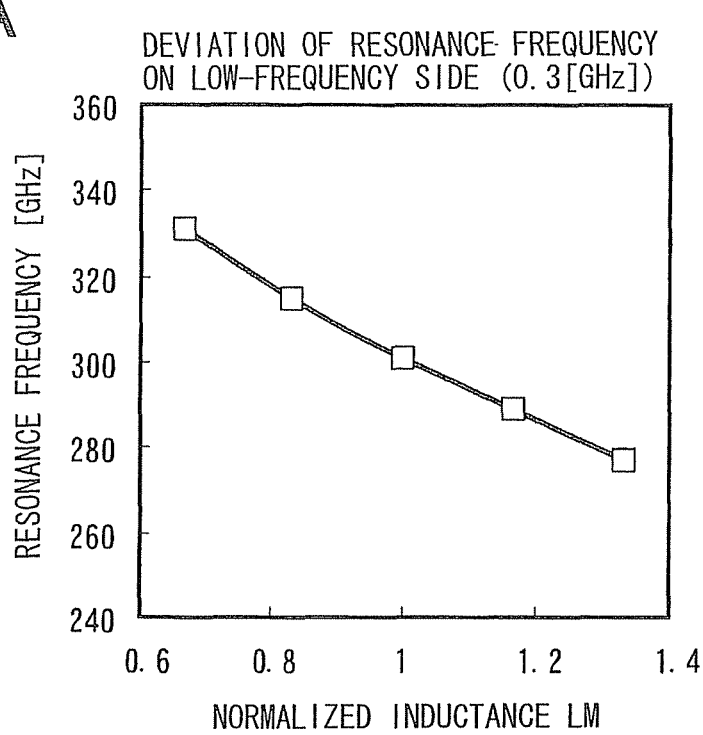
FIGS. 5A and 5B are graphs illustrating the change of two resonance frequencies of the multi-band antenna with the change of an inductance $L_M$ of a second inductor according to the first embodiment.
Figure 5B:
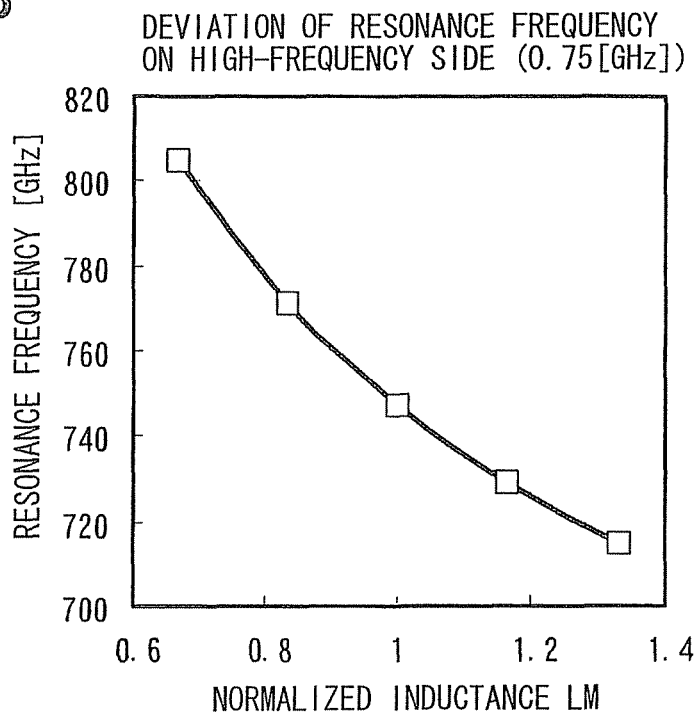
Figure 6A:
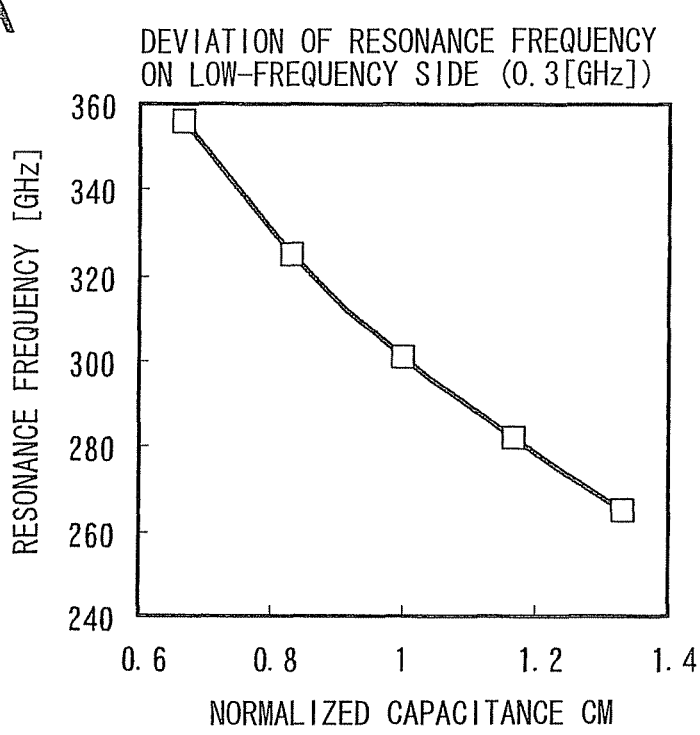
FIGS. 6A and 6B are graphs illustrating the change of the two resonance frequencies with the change of a capacitance $C_M$ of a second capacitor according to the first embodiment.
Figure 6B:
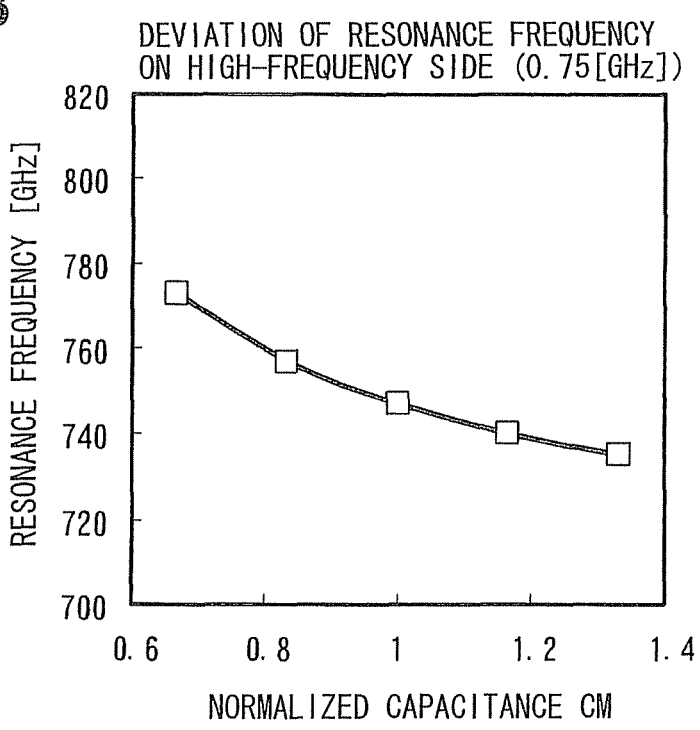

FIG. 5A is a graph illustrating a change of the resonance frequency on a low-frequency side, that is, the resonance frequency on a side of 0.3 GHz shown by the point C in FIG. 4, with respect to the normalized inductance $L_M$ of the second inductor 42. FIG. 5B is a graph illustrating a change of the resonance frequency on a high-frequency side, that is, the resonance frequency on a side of 0.75 GHz shown by the point D in FIG. 4, with respect to the normalized inductance $L_M$ of the second inductor 42. FIG. 6A is a graph illustrating a change of the resonance frequency on the low-frequency side with respect to the normalized capacitance $C_M$ of the second capacitor 52. FIG. 6B is a graph illustrating a change of the resonance frequency on the high-frequency side with respect to the normalized capacitance $C_M$ of the second capacitor 52.

As shown in FIG. 5A, the resonance frequency on the low-frequency side can be continuously changed with the change of the inductance $L_M$ of the second inductor 42. Also, as shown in FIG. 5B, the resonance frequency on the high-frequency side can be continuously changed with the change of the inductance $L_M$ of the second inductor 42.

Further, as shown in FIG. 6A, the resonance frequency on the low-frequency side can be continuously changed with the change of the capacitance $C_M$ of the second capacitor 52. Also, as shown in FIG. 6B, the resonance frequency on the high-frequency side can be continuously changed with the change of the capacitance $C_M$ of the second capacitor 52.

As described above, two resonance frequencies of the multi-band antenna 1 can be continuously changed by changing the inductance $L_M$ of the second inductor 42 and the capacitance $C_M$ of the second capacitor 52.

(Features of the Multi-Band Antenna 1)

Hereinabove, the multi-band configuration of the multi-band antenna 1 has been quantitatively described with reference to the numerical expressions. Hereinafter, the multi-band configuration of the multi-band antenna 1 will be qualitatively described based on FIGS. 7A and 7B. FIGS. 7A and 7B are diagrams illustrating how the components of the multi-band antenna 1 operate at the respective resonance frequencies.

As shown in FIG. 7A, with regard to the resonance frequency on the high-frequency side, the second inductor 42 ($L_M$) is approximated to an open state, and the third capacitor 54 ($C_R$) is approximated to an open state. Therefore, the resonance frequency is mainly determined by operations of the first capacitor 50 ($C_L$) and the first inductor 40 ($L_L$) (i.e., elements surrounded by single-dashed chain lines in FIG. 7A).

As shown in FIG. 7B, with regard to the resonance frequency on the low-frequency side, the first capacitor 50 ($C_L$) is approximated to an open state, and the third capacitor 54 ($C_R$) is approximated to an open state. Therefore, effects of the second inductor 42 ($L_M$) and the second capacitor 52 ($C_M$) are increased, and the resonance frequency is mainly determined by operations of the second inductor 42 ($L_M$) and the second capacitor 52 ($C_M$) (i.e., elements surrounded by single-dashed chain lines in FIG. 7B).

As described above, the frequency points can be obtained in the high-frequency side and the low-frequency side. In other words, the radio waves having two frequencies can be transmitted and received.

In general, a structure where the third inductors 44 ($L_R$) are disposed in series with the two metal wirings 10, 12 and the third capacitor 54 ($C_R$) is disposed in parallel with the two metal wirings 10, 12 is referred to as a right-handed material. A structure in which units each having the first capacitor 50 ($C_L$) connected in series with the third inductor 44 ($L_R$) of the right-handed material and the first inductor 50 ($L_L$) connected in parallel with the third capacitor 54 ($C_R$) are cascaded is referred to as a meta-material or a left-handed material.

In the case where the first inductor 40 ($L_L$), the first capacitor 50 ($C_L$), the second inductor 42 ($L_M$), the second capacitor 52 ($C_M$), the third inductor 44 ($L_R$) disposed in series with the two metal wirings 10, 12, and the third capacitor 54 ($C_R$) disposed between the two metal wirings 10, 12 satisfy the relationship of the expression 1, the resonance points, that is, each inductor and each capacitor for obtaining desirable frequencies are numerically limited. Therefore, the values of each inductor and each capacitor are easily determined.

The two metal wirings 10, 12 are provided by conductor patterns formed on the printed board 80. The conductor patterns of the first inductor 40 ($L_L$) and the second inductor 42 ($L_M$) have the meandering shapes. The conductor patterns of the first capacitor 50 ($C_L$) and the second capacitor 52 ($C_M$) have the comb-teeth shapes.

That is, the inductors and capacitors are provided by the conductor patterns formed on the printed board 80. Therefore, the size of the multi-band antenna 1 can be reduced, and the loss of the multi-band antenna 1 can be reduced.

Second Embodiment

Figure 8A:
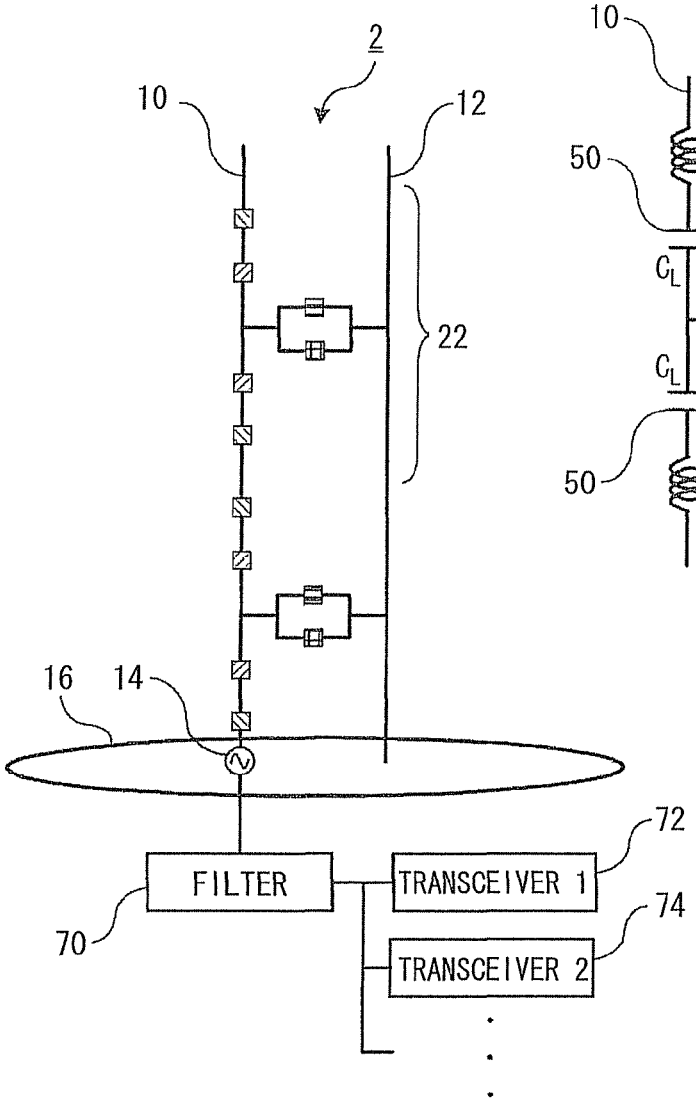
FIG. 8A is a schematic diagram of a multi-band antenna according to a second embodiment.

A second embodiment will be described with reference to FIGS. 8A, 8B, 9 and 10. FIG. 8A is a diagram schematically illustrating a multi-band antenna 2 according to the second embodiment.

(Structure of Multi-Band Antenna 2)

Referring to FIG. 8A, a multi-band antenna 2 is a monopole type antenna constructed by cascading multiple unit circuits 22 having the same structure along two metal wirings 10, 12 as a basic structure. The two metal wirings 10, 12 are substantially parallel to each other, and are provided as conductive wirings.

A first end of the metal wiring 10 is a feeding point 14, and is connected to multiple transmitting and receiving devices 72, 74 etc. through a band filter 70. A second end of the metal wiring 10 is an open end.

A first end of the metal wiring 12, which is on the same side as the first end of the metal wiring 10, is connected to a GND plate 60 so as to avoid a transmission signal reflecting.

The multi-band antenna 2 having the above-described structure enables to transmit and receive radio waves in association with the multiple transmitting and receiving devices 72, 74 etc.

In an actual device of the multi-band antenna 2, the two metal wirings 10, 12 are provided by conductor patterns such as copper foil formed on the printed board 80, similar to the multi-band antenna 1 of the first embodiment.

Figure 8B:
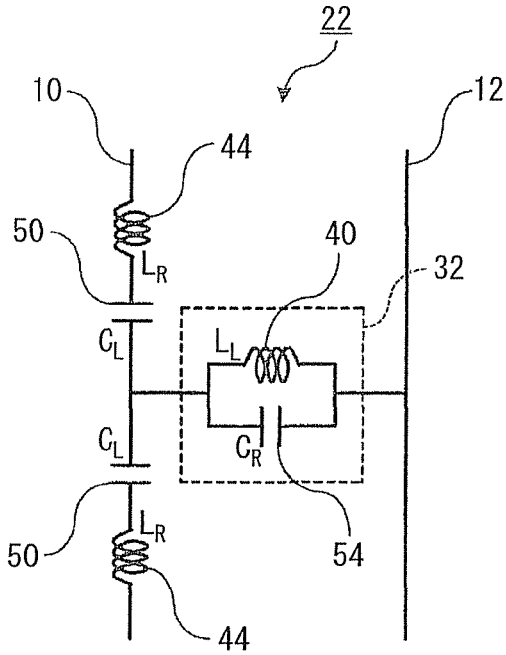
FIG. 8B is a circuit diagram of a unit circuit of the multi-band antenna according to the second embodiment.
Figure 9:
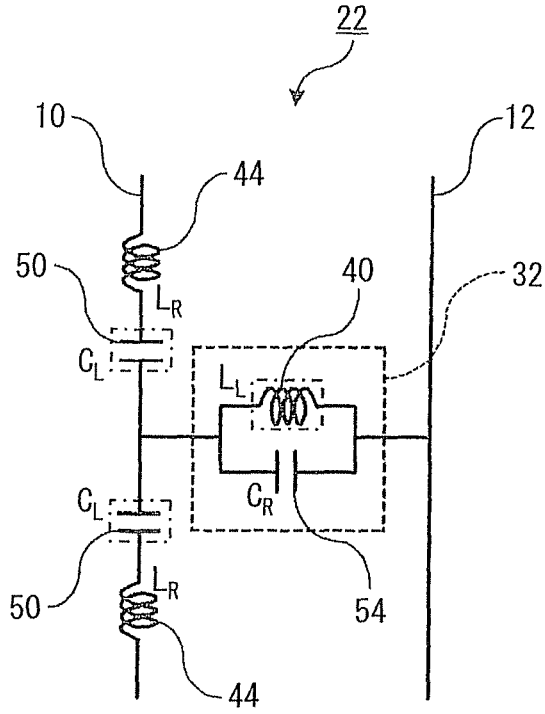
FIG. 9 is a schematic diagram for illustrating operations of components of the multi-band antenna according to the second embodiment.

As shown in FIG. 8B, the unit circuit 22 includes a communication unit 32 and a first capacitor 50 ($C_L$). The communication unit 32 has a circuit structure that connects the two metal wirings 10, 12 to each other through a first inductor 40 ($L_L$). The first capacitor 50 ($C_L$) is inserted in the metal wiring 10. In the present embodiment, for example, two first capacitors 50 ($C_L$) are inserted in the metal wiring 10 on opposite sides of the connecting point to the communication unit 32.

In an actual device, the first inductor 40 ($L_L$) is provided by a conductor pattern having a meandering shape and formed on the printed board 80, as shown in FIG. 2A. Also, the first capacitor 50 ($C_L$) is provided by a conductor pattern having a comb-teeth shape and formed on the printed board 80, as shown in FIG. 2A.

(Relationship Between Inductor and Capacitor)

In the multi-band antenna 2 having the above-described structure, the first inductor 40 ($L_L$), the first capacitor 50 ($C_L$), a third capacitor 54 ($C_R$) disposed between the two metal wirings 10, 12 and a third inductor 44 ($L_R$) disposed in series with the two metal wirings 10, 12 satisfy a relationship expressed by the following expression 2:

$$\sqrt{\frac{1}{L_L C_R}} = \frac{-A + \sqrt{A^2 + \frac{4L_R}{C_L}}}{2L_R} \quad \text{Ex. 2}$$

(Feature of Multi-Band Antenna 2)

In the multi-band antenna 2 described above, as shown in FIG. 9, on the low-frequency side, the third inductor 44 ($L_R$) is approximated to a short-circuit state and the third capacitor 54 ($C_R$) is approximated to an open state. Therefore, operations of the first inductor 40 ($L_L$) and the first capacitor 50 ($C_L$) (i.e., elements surrounded by single-dashed chain lines in FIG. 9) are dominant.

On the other hand, on the high-frequency side, due to resonance (antiresonance) of the first inductor 40 ($L_L$) and the first capacitor 50 ($C_L$), impedance becomes high at the frequency. Therefore, an electric current is distributed to the metal wiring 10, which is on a feeding side. The resonance frequency $\omega_1$ in this case is expressed by the following expression 6:

$$\varpi_1 = \sqrt{\frac{1}{L_L C_R}} \quad \text{Ex. 6}$$

At the above resonance frequency (antiresonance frequency), the value $L_R$ of the third inductor 44 and the value $C_L$ the first capacitor 50 are determined so that an imaginary part A of radiation impedance of the metal wiring 10 on the feeding side is negated. In such a case, therefore, the radio wave is efficiently radiated from the metal wiring 10.

In this case, the imaginary part A, the third inductor 44 ($L_r$), and the first capacitor 50 ($C_L$) satisfy a relationship expressed by the following expression 7:

$$A + \varpi_1 L_R - \frac{1}{\varpi_1 C_L} = 0 \quad \text{Ex. 7}$$

Therefore, the resonance frequency $\omega_1$ is expressed as follows:

$$\varpi_1 = \frac{-A + \sqrt{A^2 + \frac{4L_R}{C_L}}}{2L_R} \quad \text{Ex. 8}$$

The following expression 2 is introduced with reference to the first inductor 40 ($L_L$), the third inductor 44 ($L_R$), the first capacitor 50 ($C_L$), and the imaginary part A of the radiation impedance of the metal wiring 10 based on the above expressions 7 and 8.

$$\sqrt{\frac{1}{L_L C_R}} = \frac{-A + \sqrt{A^2 + \frac{4L_R}{C_L}}}{2L_R} \quad \text{Ex. 2}$$

Figure 10:
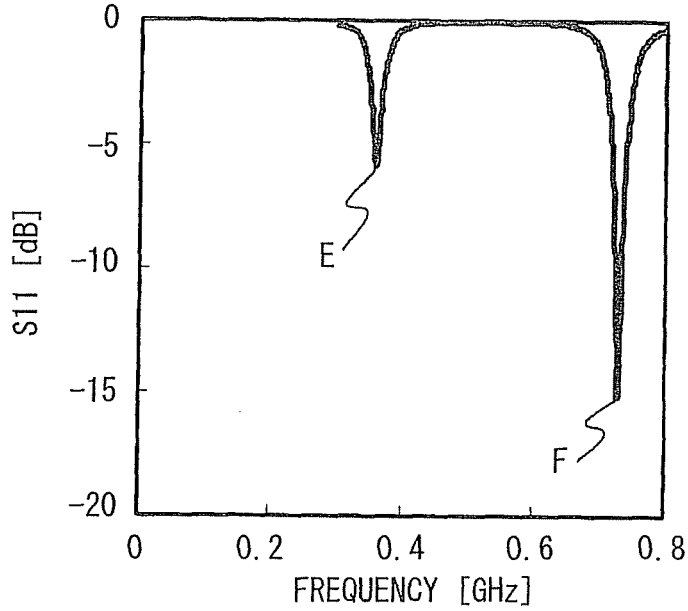
FIG. 10 is a graph illustrating an analysis result of an input characteristic of the multi-band antenna according to the second embodiment.

FIG. 10 is a graph illustrating an analysis result of an input characteristic S11 of the multi-band antenna 2, which satisfies the relationship expressed by the expression 2. As shown in FIG. 10, the multi-band antenna 2 resonates at two frequencies, such as a point E of 0.36 GHz and a point F of 0.73 GHz, and thus it is appreciated that the multi-band configuration is provided.

It is to be noted that the third inductor 44 ($L_R$) is an inductor that is necessarily disposed on the metal wiring 10, as described above. Therefore, the value $L_R$ of the third inductor 44 can be determined by changing the length of the metal wiring 10 in the unit circuit 22, by forming an inductor with a conductive pattern on the printed board 80, or by adding a discrete part, such as a coil.

Other Embodiments

The exemplary embodiments are described hereinabove. However, the present disclosure is not limited to the above described exemplary embodiments, but may be modified in various other ways.

(1) In the above described embodiments, the first through third inductors 40, 42, 44 and the first through third capacitors 50, 52, 54 are implemented by the conductor patterns formed on the printed board 80. However, in a case where it is difficult to obtain desired inductance and/or capacitance by such conductive patterns, the desired inductance and/or capacitance can be obtained by using a discrete part(s) or the like, for example.

(2) In the first embodiment, the two second inductors 42 ($L_M$) are disposed on the metal wiring 10 on opposite sides of the connecting point connecting to the communication unit 30. In the second embodiment, the two first capacitors 50 ($C_L$) are disposed on the metal wiring 10 on opposite sides of the connecting point connecting to the communication unit 32. However, it is not always necessary that the second inductors 42 ($L_M$) and the first capacitors 50 ($C_L$) are disposed on the opposite sides of the connecting point, and one of the second inductors 42 ($L_M$) or one of the first capacitors ($C_L$) may be eliminated In such a case, it is necessary to change the value $L_M$ of the second inductor 42 or the value $C_L$ of the first capacitor 50.

While the present disclosure has been described with reference to the exemplary embodiments thereof, it is to be understood that the disclosure is not limited to the exemplary embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A multi-band antenna comprising:

two conductive wirings, which are substantially parallel to each other; and a plurality of unit circuits cascaded along the two conductive wirings, each of the unit circuits including:

a communication unit that connects between the two conductive wirings through a first inductor and a second capacitor connected in series with the first inductor; and a first capacitor and a second inductor that are inserted in at least one of the two conductive wirings, the second inductor being connected in parallel with the first capacitor; wherein the first inductor, the first capacitor, the second inductor, the second capacitor, a third inductor disposed in series with at least one of the two conductive wirings, and a third capacitor disposed between the two conductive wirings satisfy a relationship expressed by a following expression 1:

$$\sqrt{\frac{1}{L_L C_M}} \le \sqrt{\frac{1}{(L_R + L_M)C_L}} \le \sqrt{\frac{1}{L_L C_R}\left(1 + \frac{C_R}{C_M}\right)} \le \sqrt{\frac{1}{L_R C_L}} \quad \text{Ex. 1}$$

in which $L_L$ is a value of the first inductor, $C_L$ is a value of the first capacitor, $L_M$ is a value of the second inductor, $C_M$ is a value of the second capacitor, $L_R$ is a value of the third inductor, and $C_R$ is a value of the third capacitor.

2. The multi-band antenna according to claim 1, wherein the two conductive wirings are provided by conductor patterns disposed on a printed board, and at least one of the first inductor, the second inductor, the first capacitor and the second capacitor is provided by a conductor pattern disposed on the printed board.

3. A multi-band antenna comprising:

two conductive wirings, which are substantially parallel to each other; and a plurality of unit circuits cascaded along the two conductive wirings, each of the unit circuits including:

a communication unit that connects the two conductive wirings through a first inductor; and a first capacitor inserted in at least one of the two conductive wirings, wherein the first inductor, the first capacitor, a third capacitor disposed between the two conductive wirings, and a third inductor disposed in series with at least one of the two conductive wirings satisfy a relationship expressed by a following expression 2:

$$\sqrt{\frac{1}{L_L C_R}} = \frac{-A + \sqrt{A^2 + \frac{4L_R}{C_L}}}{2L_R} \quad \text{Ex. 2}$$

in which $L_L$ is a value of the first inductor, $C_L$ is a value of the first capacitor, $C_R$ is a value of the third capacitor, $L_R$ is a value of the third inductor, and A is an imaginary part of a radiation impedance of one of the two conductive wirings.

4. The multi-band antenna according to claim 3, wherein the two conductive wirings are provided by conductive patterns disposed on a printed board, and at least one of the first inductor and the first capacitor is provided by a conductor pattern disposed on the printed board.

* * * * *